US007208705B2

(12) United States Patent
Hwang et al.

(10) Patent No.: US 7,208,705 B2
(45) Date of Patent: Apr. 24, 2007

(54) HEATER BRACKET ASSEMBLY FOR DRYER

(75) Inventors: Sung Gi Hwang, Changwon-si (KR); Jung Woo Seo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 84 days.

(21) Appl. No.: 10/933,428

(22) Filed: Sep. 3, 2004

(65) Prior Publication Data

US 2005/0115953 A1 Jun. 2, 2005

(30) Foreign Application Priority Data

Nov. 28, 2003 (KR) ..... 10-2003-0085616

(51) Int. Cl.
*H05B 3/06* (2006.01)

(52) U.S. Cl. ..... 219/536; 34/603

(58) Field of Classification Search ..... 219/536, 219/537–538, 520; 34/132, 595, 603
See application file for complete search history.

(56) References Cited

U.S. PATENT DOCUMENTS 4,453,533 A * 6/1984 Scheidler et al. ..... 126/211
4,700,495 A * 10/1987 Drews et al. ..... 34/603
4,811,495 A * 3/1989 Huang et al. ..... 34/131
5,042,171 A * 8/1991 Obata et al. ..... 34/604
5,072,526 A * 12/1991 Hirota et al. ..... 34/60
5,895,597 A * 4/1999 Sherrill ..... 219/536
6,108,940 A * 8/2000 St. Louis ..... 34/601
6,886,799 B2 * 5/2005 Yamanashi ..... 248/610

* cited by examiner

*Primary Examiner*—Robin Evans
*Assistant Examiner*—Vinod Patel
(74) *Attorney, Agent, or Firm*—McKenna Long & Aldridge LLP

(57) ABSTRACT

A heater bracket assembly for securing a heater case in a dryer is disclosed. The heater bracket assembly includes a supporting part secured to a bottom end of the heater case for supporting the heater case, a fixing part secured to a base plate of the dryer, and a connecting part connecting the supporting part and the fixing part, wherein the supporting part comprises a first extension member extended therefrom which engages with an aperture provided to the bottom end of the heater case such that the supporting part is initially secured to the heater case.

20 Claims, 5 Drawing Sheets

HEATER BRACKET ASSEMBLY FOR DRYER

This application claims the benefit of Korean Application No. P2003-085616, filed on Nov. 28, 2003, which is hereby incorporated by reference.

BACKGROUND OF THE INVENTION

1. Field of the Invention

The present invention relates to a dryer, and more particularly, to a heater bracket assembly for securing a heater case in a dryer.

2. Discussion of the Related Art

Generally, a laundry dryer is a home appliance for drying a wet laundry automatically. The dryer is provided with a heater for drying a laundry and a heater bracket assembly supporting the heater. The heater bracket assembly is explained in detail by referring to the attached drawings as follows.

Referring to FIG. 1, a dryer 1 consists of a case 10 forming an exterior and a base plate 20 forming a bottom side. An opening 30 is formed in a front side of the case 10 to put/pull a laundry in/from the case and a door 40 is provided to the opening 30 to open/close. And, a drum 50 is rotatably provided within the case 10 to dry a wet laundry therein. Meanwhile, a heater 61 providing hot air to the drum 50 and a heater case 62 accommodating the heater 61 are provided within a space between the drum 50 and the base plate 20. And, the heater case 62 is fitted in a duct 80 having one open end and the other end communicating with the drum 50 to be coupled thereto without a separate fixing member.

In order to fix the heater case 62 to the base plate 20, a heater bracket assembly 70 is provided. A process of assembling the heater bracket assembly 70, base plate 20, and heater case 62 is explained by referring to FIG. 2 as follows. The heater bracket assembly 70 has a '⊔'type cross-section. Holes 21 and 71 are formed at both lower ends of the heater bracket assembly 70 and the base plate 20, respectively. A fixing member is fitted in the corresponding holes 21 and 71 to fix the heater bracket assembly 70 to the base plate 20.

Meanwhile, an upper end of the heater bracket assembly 70 supports the heater case 62 without a separate fixing member. However, when the heater bracket assembly supports the heater case in the above-explained manner, the following problems are inevitable.

First of all, the heater bracket assembly 70 and the heater case 62 are shaken when the dryer is carried or installed. Namely, when the dryer is shaken, the heater case is detached from the duct to be movable within the dryer. Secondly, in fixing the heater bracket to the base plate, it takes quite a long working time to align the holes of the base plate and heater bracket assembly to each other. Moreover, the corresponding fixing work is not facilitated.

SUMMARY OF THE INVENTION

Accordingly, the present invention is directed to a heater bracket assembly for a dryer that substantially obviates one or more of the problems due to limitations and disadvantages of the related art.

An object of the present invention, which has been devised to solve the foregoing problem, lies in providing a heater bracket assembly for a dryer, by which a heater case is prevented from being separated from a duct.

Another object of the present invention to provide a heater bracket assembly for a dryer, by which the heater bracket assembly is easily fixed to a base plate and by which a corresponding working time is shortened.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a heater bracket assembly for securing a heater case in a dryer includes a supporting part secured to a bottom end of the heater case for supporting the heater case, a fixing part secured to a base plate of the dryer, and a connecting part connecting the supporting part and the fixing part, wherein the supporting part comprises a first extension member extended therefrom which engages with an aperture provided to the bottom end of the heater case such that the supporting part is initially secured to the heater case.

Herein, the fixing part may include a second extension member extended therefrom which engages with an aperture provided on the base plate such that the fixing part is initially secured to the base plate. The second extension member may include a first protrusion protruding downward from a portion of the fixing part to penetrate the aperture provided on the base plate, and a second protrusion protruding forward from a tip of the first protrusion to be in contact with and be supported by a bottom side of the base plate. A tip portion of the second protrusion is tilted such that the second extension member easily engages with the aperture provided on the base plate.

The supporting part may include at least one through-hole adopted to receive a fastener for securing the bottom end of the heater case to the supporting part. Herein, the fixing part may include at least one through-hole adopted to receive a fastener for securing the fixing part to the base plate. Also, at least one bead is provided to the connecting part for rigidity reinforcement, and the connecting part is tilted forward.

In another aspect of the present invention, a heater bracket assembly for securing a heater case in a dryer includes a supporting part secured to a bottom end of the heater case for supporting the heater case, a fixing part secured to a base plate of the dryer, a connecting part connecting the supporting part and the fixing part, a first extension member extended from the supporting part for engaging with an aperture provided to the bottom end of the heater case, and a second extension member extended from the fixing part for engaging with an aperture provided on the base plate.

In a further aspect of the present invention, a heater bracket assembly for securing a heater case in a dryer includes a supporting part secured to a bottom end of the heater case for supporting the heater case, a fixing part secured to a base plate of the dryer, a connecting part connecting the supporting part and the fixing part, the connecting part being tilted forward, a first extension member extended from the supporting part for engaging with an aperture provided to the bottom end of the heater case, a second extension member extended from the fixing part for engaging with an aperture provided on the base plate, and at least one bead provided to the connecting part for rigidity reinforcement.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
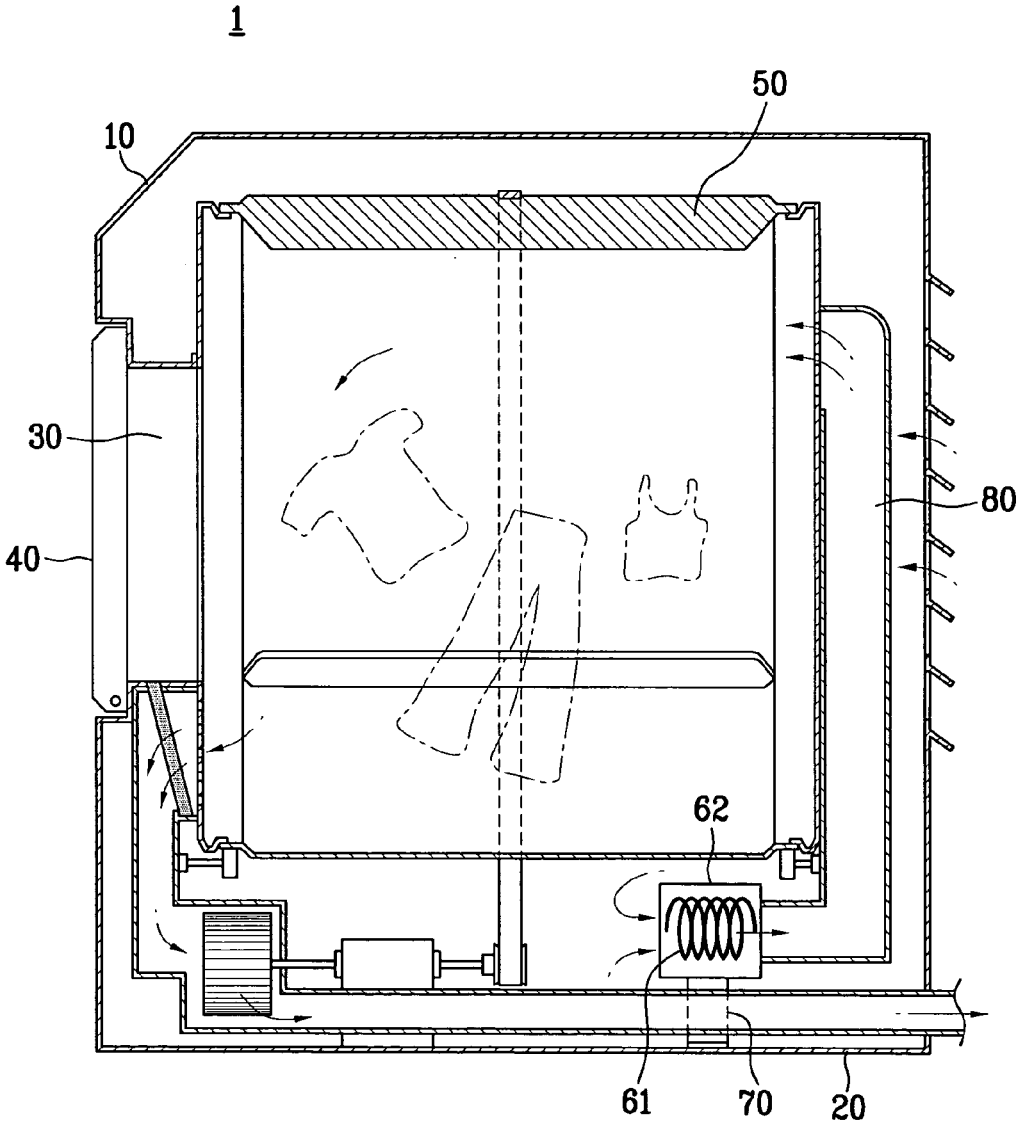
FIG. 1 Related Art
FIG. 1 is a cross-sectional diagram of a dryer according to a related art.
Figure 2:
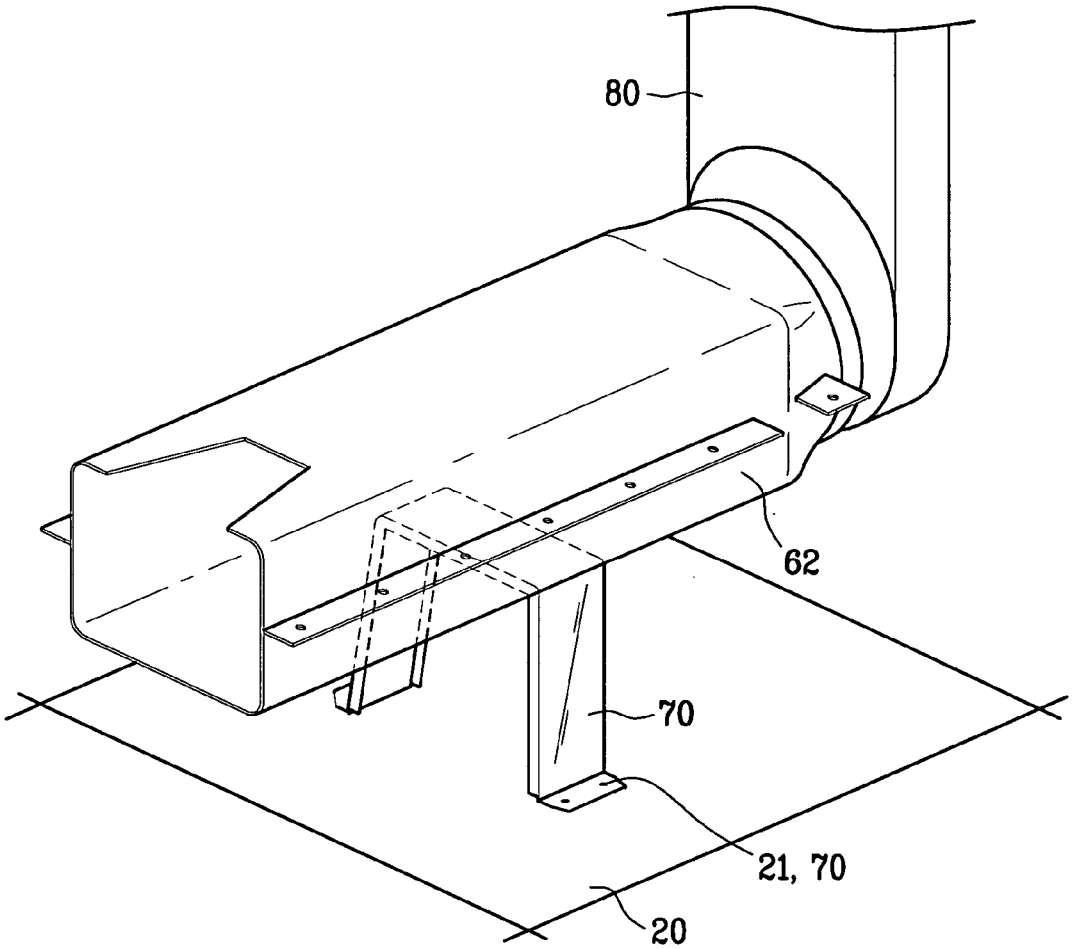
FIG. 2 Related Art
FIG. 2 is a perspective diagram of a heater bracket assembly according to a related art.
Figure 3:
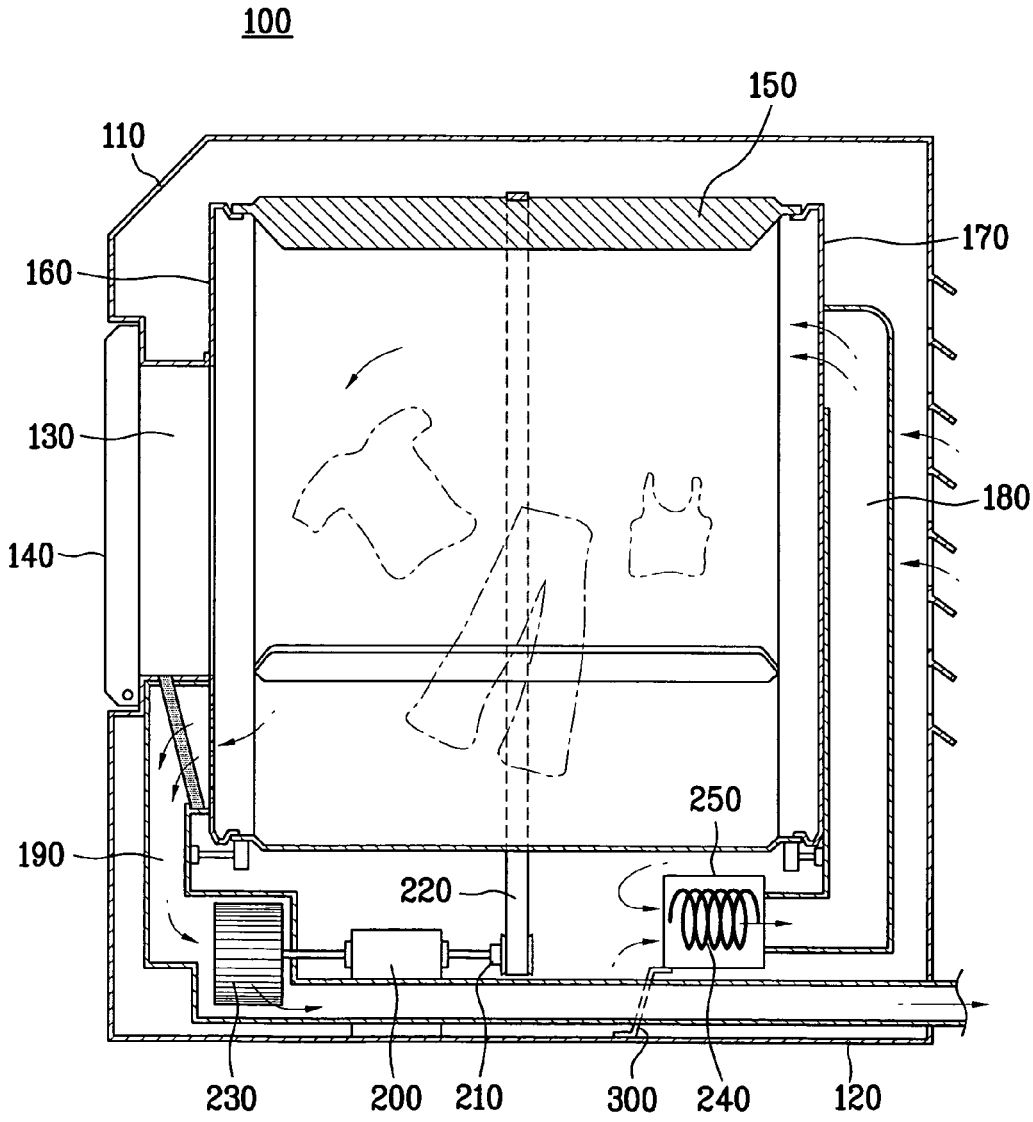
FIG. 3 is a cross-sectional diagram of a dryer according to the present invention.

FIG. 3 is a cross-sectional diagram of a dryer 100 provided with a heater bracket assembly 300 according to the present invention. Referring to FIG. 3, a dryer 100 includes a base plate 120 forming a bottom side and a case 110 on the base plate 120 to form an exterior and. An opening 130 is formed in a front side of the case 110 to put/pull a laundry in/from the case and a door 140 is provided to the opening 130 to open/close. A drum is rotatably provided within the case 110 to hold a laundry therein. Front and rear sides of the drum are rotatably coupled to front and rear supports 160 and 170, respectively. An inlet duct 180 provided in rear of the drum and an outlet duct 190 is provided in front of the drum, whereby the drum can be externally ventilated. The inlet and outlet ducts 180 and 190 are coupled to upper and lower parts of the drum, respectively.

A motor 200 is provided under the drum to generate a rotational force. In order to transfer the rotational force generated from the motor 200 to the drum, a pulley 210 is coupled to one side of the motor 200 and the pulley 210 is connected to the drum via belt 220. A blower fan 230 is connected to the other side of the motor 200. The blower fan 230 is connected to the outlet duct 190 to suck the air inside the drum to discharge outside the case 110. A heater 240 is provided under the drum to dry the laundry held within the drum. The heater 240 heats air to supply the heated air to the drum. The heater 240 is provided within a heater case 250. In order for the heater 240 to heat the air, one side of the heater case 250 is open and the other side of the heater case 250 is connected to the inlet duct 180.

Figure 4:
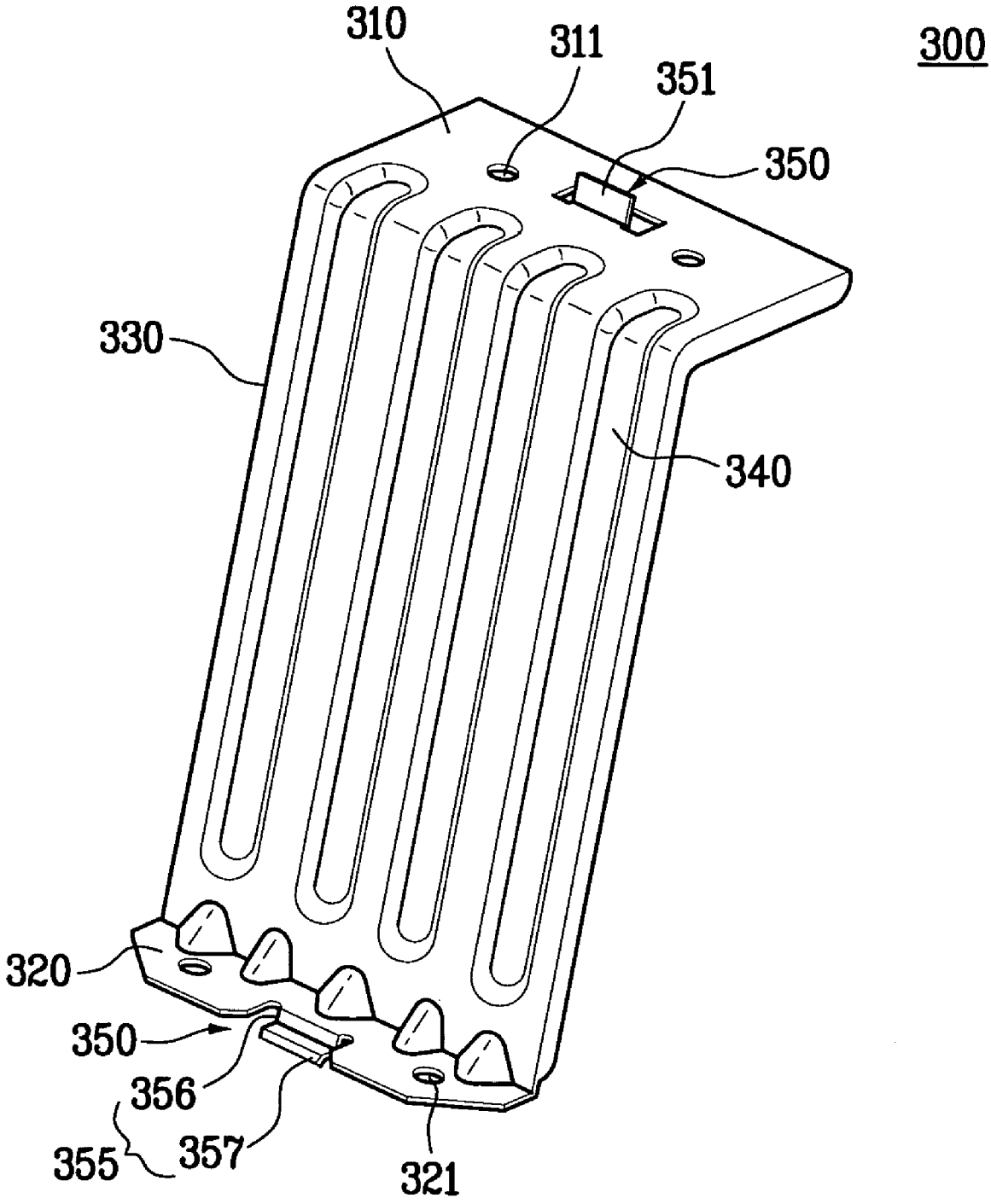
FIG. 4 is a perspective diagram of the heater bracket assembly according to the present invention.
Figure 5:
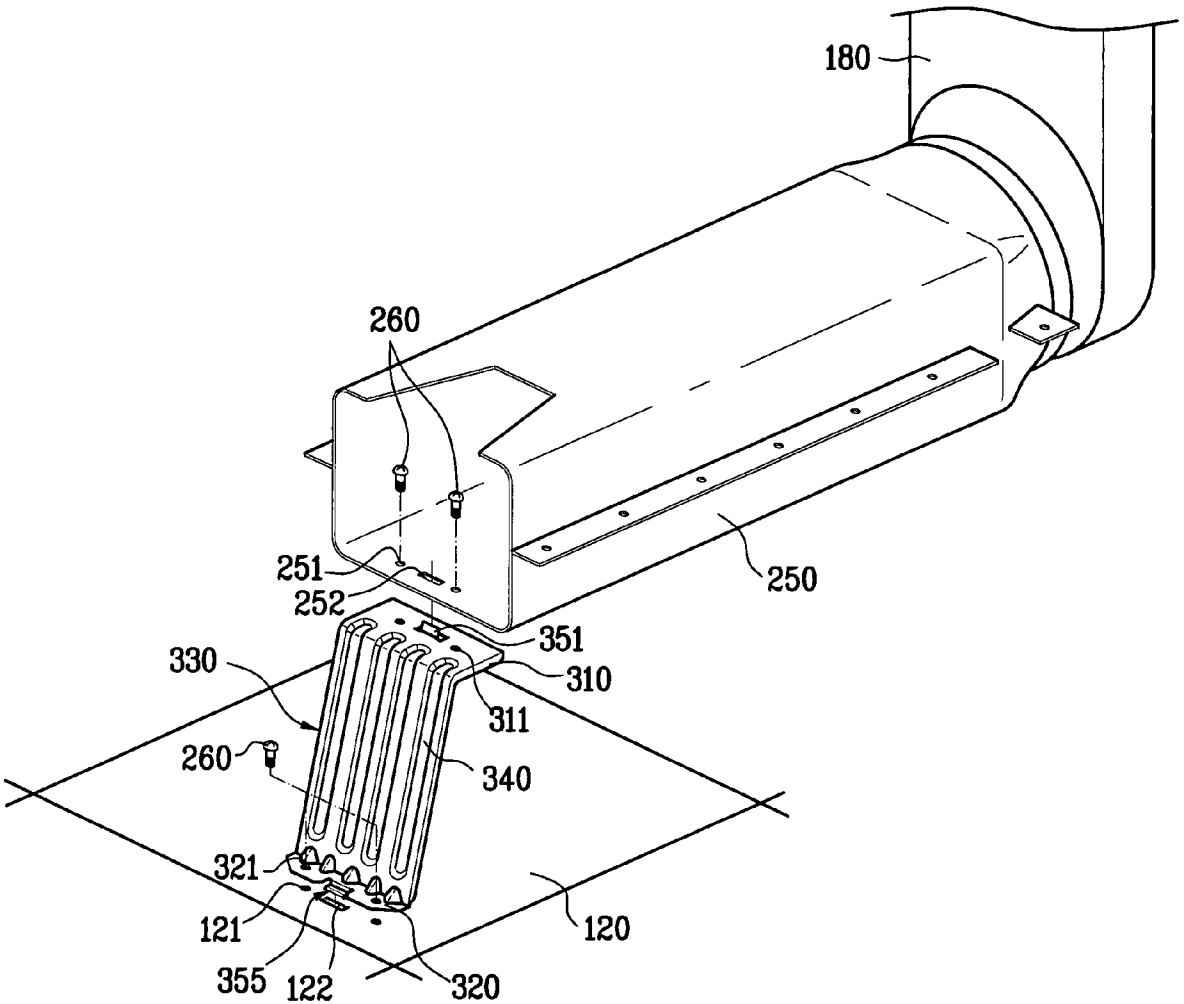
FIG. 5 is perspective diagram of the heater bracket assembly coupled to a heater case according to the present invention.

Meanwhile, the heater case 250 is provided over the base plate 120 via a heater bracket assembly 300. The heater bracket assembly 300 is explained by referring to FIGS. 4 and 5 as follows. The heater bracket assembly 300 includes a supporting part 310, a fixing part 320, and a connecting part 330. The supporting part 310 supports a bottom side of the heater case 250. Specifically, the supporting part 310 is fixed (or secured) to a bottom of an open side of the heater case 250 to support the heater case 250. Holes 251 and 311 are formed in the heater case 250 and the supporting part 310, respectively, so as to allow a fixing member 260 to pass through. The fixing member 260 is inserted in both of the holes 251 and 311 to fix the heater case 250 to the supporting part 310.

Meanwhile, the fixing part 320 is fixed to a topside of the base plate 120. Holes 321 and 121 are formed in the fixing part 320 and base plate 120 to be penetrated by a fixing member 260. The corresponding fixing member 260 is inserted in the holes 321 and 121 to fix the fixing part 320 to the base plate 120. The fixing member 260 preferably includes a bolt and nut or a rivet. The connecting part 330 connects the fixing part 320 and the supporting part 310. And, the connecting part 330 is tilted forward from the supporting part 310 to the fixing part 320. Moreover, the connecting part 330 is provided with at least one bead 340 for rigidity reinforcement.

The bead 340 prevents the connecting part 330 from being bent by a weight applied to the connecting part 330 by the heater case 250. In this case, the bead 340 is preferably projected toward a rear side of the connecting part 330. In order to facilitate to manufacture the heater bracket assembly 300, the heater bracket assembly 300 includes one plate. The one plate is bent to form the fixing, supporting, and connecting parts 320, 310, and 330.

The heater bracket assembly 300 further includes an extension member 350 provided to at least one portion of the supporting part 310 and/or the fixing part 320 to temporarily fix the heater bracket assembly 300 to the heater case 250 and/or the base plate 120 and to guide a corresponding fixing position. Specifically, the extension member 350 includes a first extension member 351 guiding to maintain a corresponding installing position before the heater case 250 is fixed to the heater bracket assembly 300 by the fixing member 260. The first extension member 351 is provided to the supporting part 310 to protrude upward from the supporting part 310. And, the heater case 250 has a hole 252 to be penetrated by the first extension member 351. Moreover, the extension member 350 penetrates the heater case 250 to prevent from moving on the supporting part 310.

And, the extension member 350 includes a second extension member 355 guiding to maintain a corresponding installing position before the heater bracket assembly 300 is fixed to the base plate 120 by the corresponding fixing member 260. The second extension member 355 is provided to the fixing part 320 to protrude downward from the fixing part 320. And, the base plate 120 has a hole 122 to be penetrated by the second extension member 355. The second extension member 355 is explained in detail in the following.

First of all, the second extension member 355 includes a first protrusion 356 protruding from a lower part of the fixing part 320 to penetrate the base plate 120 and a second protrusion 357 protruding forward from a tip of the first protrusion 356 to be supported by a bottom side of the base plate 120. The first protrusion 356 guides a fixing position when the heater bracket assembly 300 is fixed to the topside of the base plate 120. And, the second protrusion 357 is supported by the bottom side of the base plate 120 to maintain a balance of the heater bracket assembly 300 and to fix the heater bracket assembly 300 to the topside of the base plate 120. In this case, in order to facilitate to insert the second protrusion 357 in the base plate 120, a tip of the second protrusion 357 is tilted toward a ground in a front direction.

A process of assembling the heater bracket assembly 300 to the base plate 120 and the heater case 250 is explained as follows. First of all, the heater bracket assembly 300 is fixed to the topside of the base plate 120 using the second extension member 355. In doing so, the first protrusion 356 is inserted in the base plate 120 and the second protrusion 357 is supported by the bottom side of the base plate 120. Thus, the heater bracket assembly 300 enables to maintain its balance.

Secondly, the holes 321 and 121 of the fixing part 320 and base plate 120 are aligned to each other. The fixing member 260 is then inserted in the holes 321 and 121 to completely fix the heater bracket assembly 300 to the base plate 120. In this case, the fixing member 260 includes the bolt and nut or rivet.

Thirdly, the heater case 250 is temporarily fixed to the supporting part 310. In doing so, the first extension member 351 penetrates the lower part of the heater case 250. Once the first extension member 351 temporarily fixes the heater case 250 to the supporting part 310, the holes 251 and 311 of the heater case 250 and supporting part 310 are aligned to each other. The corresponding fixing member 260 then penetrates the holes 251 and 311 to completely couple the heater case 250 to the supporting part 310.

Accordingly, the heater bracket assembly according to the present invention includes the extension member temporarily fixing the heater bracket assembly to the heater case and the base plate, thereby facilitating to be fixed to the heater case and base plate and shortening a working time. And, the heater case is completely fixed to the heater bracket assembly and the heater bracket assembly is completely fixed to the base plate. Therefore, the heater case is prevented from being detached from the inlet duct.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A heater bracket assembly for securing a heater case in a dryer, comprising:

a supporting part secured to a bottom end of the heater case for supporting the heater case;

a fixing part secured to a base plate of the dryer; and a connecting part connecting the supporting part and the fixing part, wherein the supporting part comprises a first extension member extended therefrom which penetrates an aperture provided to the bottom end of the heater case, wherein the first extension member is configured to guide and secure the supporting part to the heater case before the supporting part is fixed to the heater case by fasteners.

2. The heater bracket assembly of claim 1, wherein the fixing part comprises a second extension member extended therefrom which engages with an aperture provided on the base plate such that the fixing part is initially secured to the base plate.

3. The heater bracket assembly of claim 2, wherein the second extension member comprises:

a first protrusion protruding downward from a portion of the fixing part to penetrate the aperture provided on the base plate; and a second protrusion protruding forward from a tip of the first protrusion to be in contact with and be supported by a bottom side of the base plate.

4. The heater bracket assembly of claim 3, wherein a tip portion of the second protrusion is tilted such that the second extension member easily engages with the aperture provided on the base plate.

5. The heater bracket assembly of claim 1, wherein the supporting part further comprises at least one through-hole adopted to receive a fastener for securing the bottom end of the heater case to the supporting part.

6. The heater bracket assembly of claim 1, wherein the fixing part comprises at least one through-hole adopted to receive a fastener for securing the fixing part to the base plate.

7. The heater bracket assembly of claim 1, wherein at least one bead is provided to the connecting part for rigidity reinforcement.

8. The heater bracket assembly of claim 1, wherein the connecting part is tilted forward.

9. A heater bracket assembly for securing a heater case in a dryer, comprising:

a supporting part secured to a bottom end of the heater case for supporting the heater case;

a fixing part secured to a base plate of the dryer;

a connecting part connecting the supporting part and the fixing part;

a first extension member extended from the supporting part which penetrates an aperture provided to the bottom end of the heater case, wherein the first extension member is configured to guide and secure the supporting part to the heater case before the supporting part is fixed to the heater case by fasteners; and a second extension member extended from the fixing part for engaging with an aperture provided on the base plate.

10. The heater bracket assembly of claim 9, wherein the second extension member comprises:

a first protrusion protruding downward from a portion of the fixing part to penetrate the aperture provided on the base plate; and a second protrusion protruding forward from a tip of the first protrusion to be in contact with and be supported by a bottom side of the base plate.

11. The heater bracket assembly of claim 10, wherein a tip portion of the second protrusion is tilted such that the second extension member easily engages with the aperture provided on the base plate.

12. The heater bracket assembly of claim 9, wherein the supporting part comprises at least one through-hole adopted to receive a fastener for securing the bottom end of the heater case to the supporting part.

13. The heater bracket assembly of claim 9, wherein the fixing part comprises at least one through-hole adopted to receive a fastener for securing the fixing part to the base plate.

14. The heater bracket assembly of claim 9, wherein at least one bead is provided to the connecting part for rigidity reinforcement.

15. The heater bracket assembly of claim 9, wherein the connecting part is tilted forward.

16. A heater bracket assembly for securing a heater case in a dryer, comprising:

a supporting part secured to a bottom end of the heater case for supporting the heater case;

a fixing part secured to a base plate of the dryer;

a connecting part connecting the supporting part and the fixing part, the connecting part being tilted forward;

a first extension member extended from the supporting part for engaging with an aperture provided to the bottom end of the heater case, wherein the first extension member is configured to guide and secure the supporting part to the heater case before the supporting part is fixed to the heater case by fasteners;

a second extension member extended from the fixing part for engaging with an aperture provided on the base plate; and at least one bead provided to the connecting part for rigidity reinforcement.

17. The heater bracket assembly of claim 16, wherein the second extension member comprises:

a first protrusion protruding downward from a portion of the fixing part to penetrate the aperture provided on the base plate; and a second protrusion protruding forward from a tip of the first protrusion to be in contact with and be supported by a bottom side of the base plate.

18. The heater bracket assembly of claim 17, wherein a tip portion of the second protrusion is tilted such that the second extension member easily engages with the aperture provided on the base plate.

19. The heater bracket assembly of claim 16, wherein the supporting part comprises at least one through-hole adopted to receive a fastener for securing the bottom end of the heater case to the supporting part.

20. The heater bracket assembly of claim 16, wherein the fixing part comprises at least one through-hole adopted to receive a fastener for securing the fixing part to the base plate.

* * * * *